US006549228B1

(12) United States Patent
Watanabe

(10) Patent No.: US 6,549,228 B1
(45) Date of Patent: Apr. 15, 2003

(54) MULTIPLE-BEAM LASER DIODE ADJUSTING DEVICE AND AN ADJUSTABLE CONDUCTIVE SUPPORT THEREFOR

(75) Inventor: Hiroto Watanabe, Tokyo (JP)

(73) Assignee: Pentax Corporation, Tokyo (JP)

( * ) Notice: Subject to any disclaimer, the term of this patent is extended or adjusted under 35 U.S.C. 154(b) by 0 days.

(21) Appl. No.: 09/479,061

(22) Filed: Jan. 7, 2000

(30) Foreign Application Priority Data

Jan. 8, 1999 (JP) ..... 11-002426

(51) Int. Cl.[7] ..... B41J 2/435
(52) U.S. Cl. ..... 347/245; 347/263
(58) Field of Search ..... 347/241, 242, 347/245, 256, 257, 263

(56) References Cited

FOREIGN PATENT DOCUMENTS

JP 10-244707 * 9/1998 ..... B41J/2/44

* cited by examiner

*Primary Examiner*—Hai Pham
(74) *Attorney, Agent, or Firm*—Greenblum & Bernstein, P.L.C.

(57) ABSTRACT

A multiple-beam laser diode adjusting device includes a multiple-beam laser diode which emits a plurality of laser beams, a circuit board on which a circuit for controlling a laser-emission of the multiple-beam laser diode is mounted, and an adjustable conductive support, positioned between the multiple-beam laser diode and the circuit board, which allows the multiple-beam laser diode to be rotated relative to the circuit board while ensuring an electrical connection between the multiple-beam laser diode and the circuit board.

8 Claims, 13 Drawing Sheets

Prior Art

MULTIPLE-BEAM LASER DIODE ADJUSTING DEVICE AND AN ADJUSTABLE CONDUCTIVE SUPPORT THEREFOR

BACKGROUND OF THE INVENTION

1. Field of the Invention

The present invention relates to a device for adjusting the position of a multiple-beam laser diode, used for a laser-beam scanning system, relative to a circuit board on which the multiple-beam laser diode is mounted. The present invention also relates to an adjustable conductive support therefor.

2. Description of the Related Art

Various types of laser-beam scanning systems are generally used for laser-beam printers or copiers as means for scanning a photoconductive surface of a photoconductive drum to write an image thereon. In recent years, in order to satisfy the demand for an increase in the scanning speed and the number of pixels per unit of area, a multi-beam laser scanning system has been proposed which makes it possible to write a plurality of scanning lines at each scanning sweep by emitting a corresponding plurality of laser beams at a time, which are separate from one another at predetermined intervals in the sub-scanning direction.

FIG. 10 shows fundamental elements of such a multi-beam laser scanning system. This system is provided with a multiple-beam laser diode 1, a laser-diode-driver circuit board 2, a collimating lens 3, a cylindrical lens 4, a polygon mirror (rotary light-beam deflector having a plurality of reflecting mirrors) 5, an fθ lens 6 and a reflecting mirror 7. The multiple-beam laser diode 1 is fixed to the laser-diode-driver circuit board 2.

The multiple-beam laser diode 1 outputs a plurality of laser beams. These laser beams are each collimated through the collimating lens 3. Subsequently, these collimated laser beams are made incident upon the polygon mirror 5 via the cylindrical lens 4. The polygon mirror 5 is driven to rotate at a predetermined rotational speed by a motor (not shown), so that each laser beam that is incident on the polygon mirror 5 is deflected by the polygon mirror 5, in the main scanning direction, onto a photoconductive drum 8 via the fθ lens 6 and the reflecting mirror 7. The plurality of laser beams which are incident on the photoconductive drum 8 are simultaneously deflected in the main scanning direction to scan a surface (photoconductive surface) of the photoconductive drum 8, to thereby form a corresponding plurality of main scanning lines on the photoconductive surface. The emission of each laser beam is turned ON and OFF in accordance with given image signals to draw a corresponding image (charge-latent image) on the photoconductive surface of the drum 8. Note that only one laser beam is shown in FIG. 10 for the purpose of illustration.

When finely adjusting the intervals of the plurality of laser beams in the sub-scanning direction, the multiple-beam laser diode 1 is usually rotated as shown in FIGS. 11A and 11B to adjust an interval D (shown in FIGS. 11A and 11C) of two scanning lines on the photoconductive drum 8 to an appropriate interval d (shown in FIGS. 11B and 11D). In FIGS. 11A and 11b the collimating lens 3, the cylindrical lens 4, the polygon mirror 5, the fθ lens 6 and the reflecting mirror 7 are represented by a single optical system "A" for the purpose of illustration. In a conventional multi-beam laser scanning system, a plurality of leads which come directly out of the bottom of the laser diode 1 are soldered to the laser-diode-driver circuit board 2. Therefore, when finely adjusting the intervals of the plurality of laser beams in the sub-scanning direction, the laser-diode-driver circuit board 2 needs to be shifted, e.g., from an initial position shown by a one-dot chain line to a position shown by a solid line in FIG. 12, or leads 9 of the laser diode 1, which are soldered to the laser-diode-driver circuit board 2, need to be twisted to rotate the laser diode 1 relative to the laser-diode-driver circuit board 2 as shown in FIG. 13. Accordingly, the intervals of the plurality of laser beams in the sub-scanning direction cannot be easily adjusted.

SUMMARY OF THE INVENTION

An object of the present invention is to provide a multiple-beam laser diode adjusting device which makes it possible to easily and finely adjust the intervals of the laser beams in the sub-scanning direction, which are emitted from the multiple-beam laser diode, without shifting the circuit board, to which the multiple-beam laser diode is fixed, or twisting the leads of the multiple-beam laser diode.

Another object of the present invention is to provide an adjustable conductive support which is used for such a multiple-beam laser diode adjusting device.

To achieve the objects mentioned above, according to an aspect of the present invention, a multiple-beam laser diode adjusting device is provided, including a multiple-beam laser diode which emits a plurality of laser beams; a circuit board on which a circuit for controlling a laser-emission of the multiple-beam laser diode is mounted; and an adjustable conductive support, positioned between the multiple-beam laser diode and the circuit board, which allows the multiple-beam laser diode to be rotated relative to the circuit board while ensuring an electrical connection between the multiple-beam laser diode and the circuit board.

Preferably, the adjustable conductive support includes a fixed member which is fixed to the circuit board, and a movable member to which the multiple-beam laser diode is fixed. The movable member is mounted on the fixed member to be rotatable together with the multiple-beam laser diode relative to the fixed member while ensuring the electrical connection between the multiple-beam laser diode and the circuit board.

Preferably, the multiple-beam laser diode includes a plurality of terminal leads, the movable member including a corresponding plurality of first conductive portions which are electrically connected with the plurality of terminal leads, the fixed member including a corresponding plurality of second conductive portions which contact the plurality of first conductive portions, respectively, to ensure the electrical connection between the multiple-beam laser diode and the circuit board, and the adjustable conductive support including a device which restricts rotation of the movable member within a predetermined rotational angle, wherein each of the plurality of first conductive portions is electrically connected with only a corresponding one of the plurality of second conductive portions and disconnected from any other of the plurality of second conductive portions.

According to another aspect of the present invention, an adjustable conductive support includes a movable member to which a multiple-beam laser diode is fixed, and a fixed member which is fixed to a circuit board on which a circuit for controlling a laser-emission of the multiple-beam laser diode is mounted. The movable member is mounted on the fixed member to be rotatable together with the multiple-beam laser diode relative to the fixed member while ensuring the electrical connection between the multiple-beam laser diode and the circuit board.

Preferably, the multiple-beam laser diode includes a plurality of terminal leads. The movable member includes a corresponding plurality of first conductive portions which are electrically connected with the plurality of terminal leads. The fixed member includes a corresponding plurality of second conductive portions which contact the plurality of first conductive portions, respectively, to ensure the electrical connection between the multiple-beam laser diode and the circuit board. The adjustable conductive support including a device which restricts rotation of the movable member within a predetermined rotational angle relative to the fixed member, wherein each of the plurality of first conductive portions is electrically connected with only a corresponding one of the plurality of second conductive portions and disconnected from any other of the plurality of second conductive portions.

In the above described aspects of the present invention, preferably, each of the plurality of first conductive portions remains in slidable contact with a corresponding one of the plurality of second conductive portions. Preferably, the movable member includes a first cylindrical body and two first protrusions which extend radially from the first cylindrical body in opposite directions. The fixed member including a second cylindrical body and two second protrusions which extend radially from the second cylindrical body in opposite directions. The adjustable conductive support including a fixing device for fixing the two first protrusions to the two second protrusions, respectively, the fixing device including at least one pair of screw bolts and at least one pair of corresponding screw nuts.

The present disclosure relates to subject matter contained in Japanese Patent Application No. 11-2426 (filed on Jan. 8, 1999) which is expressly incorporated herein by reference in its entirety.

BRIEF DESCRIPTION OF THE DRAWINGS

The present invention will be described below in detail with reference to the accompanying drawings in which.

DESCRIPTION OF THE PREFERRED EMBODIMENT

Figure 1:
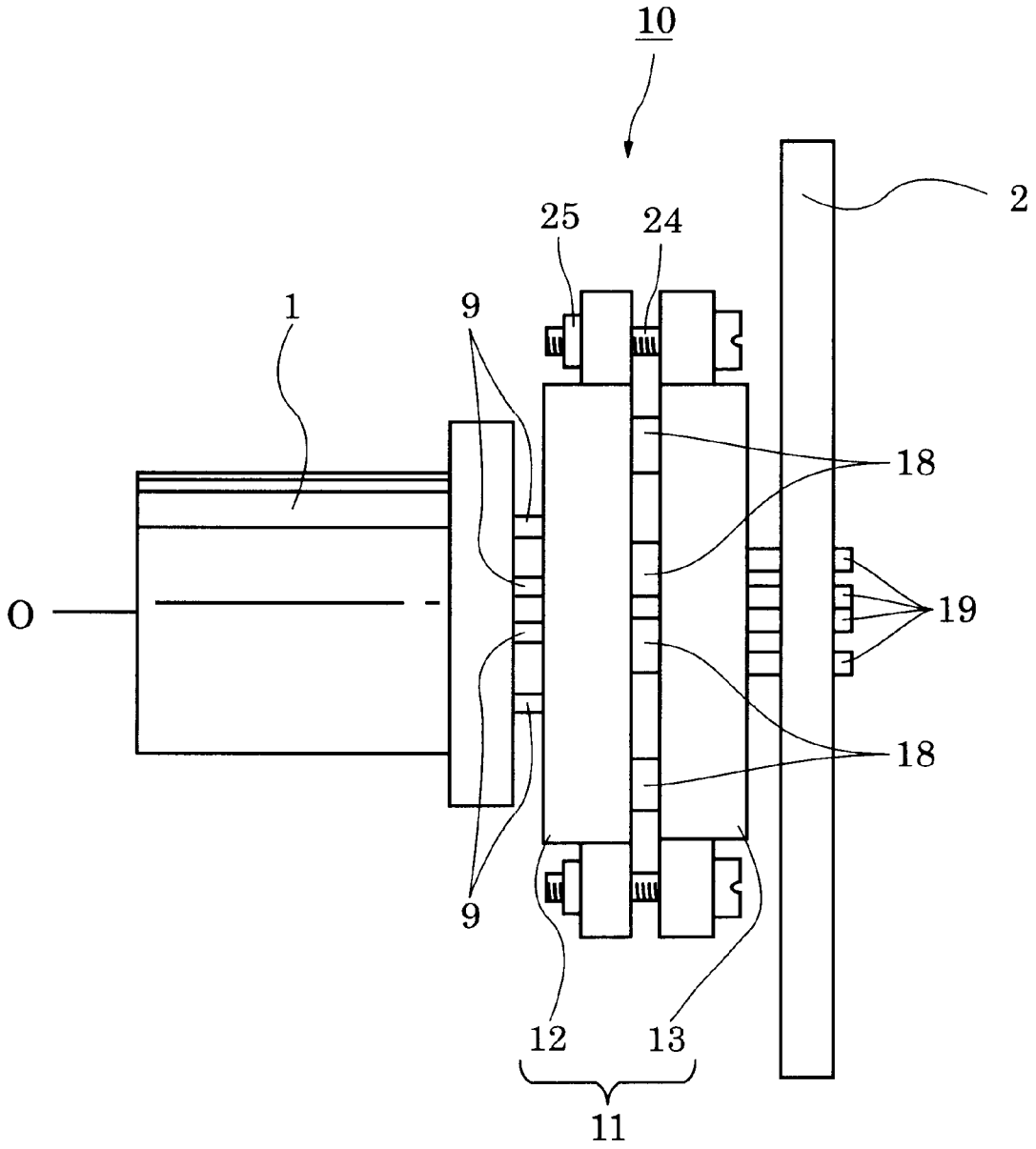
FIG. 1 is a side elevational view of an embodiment of a multiple-beam laser diode adjusting device according to the present invention.
Figure 7:
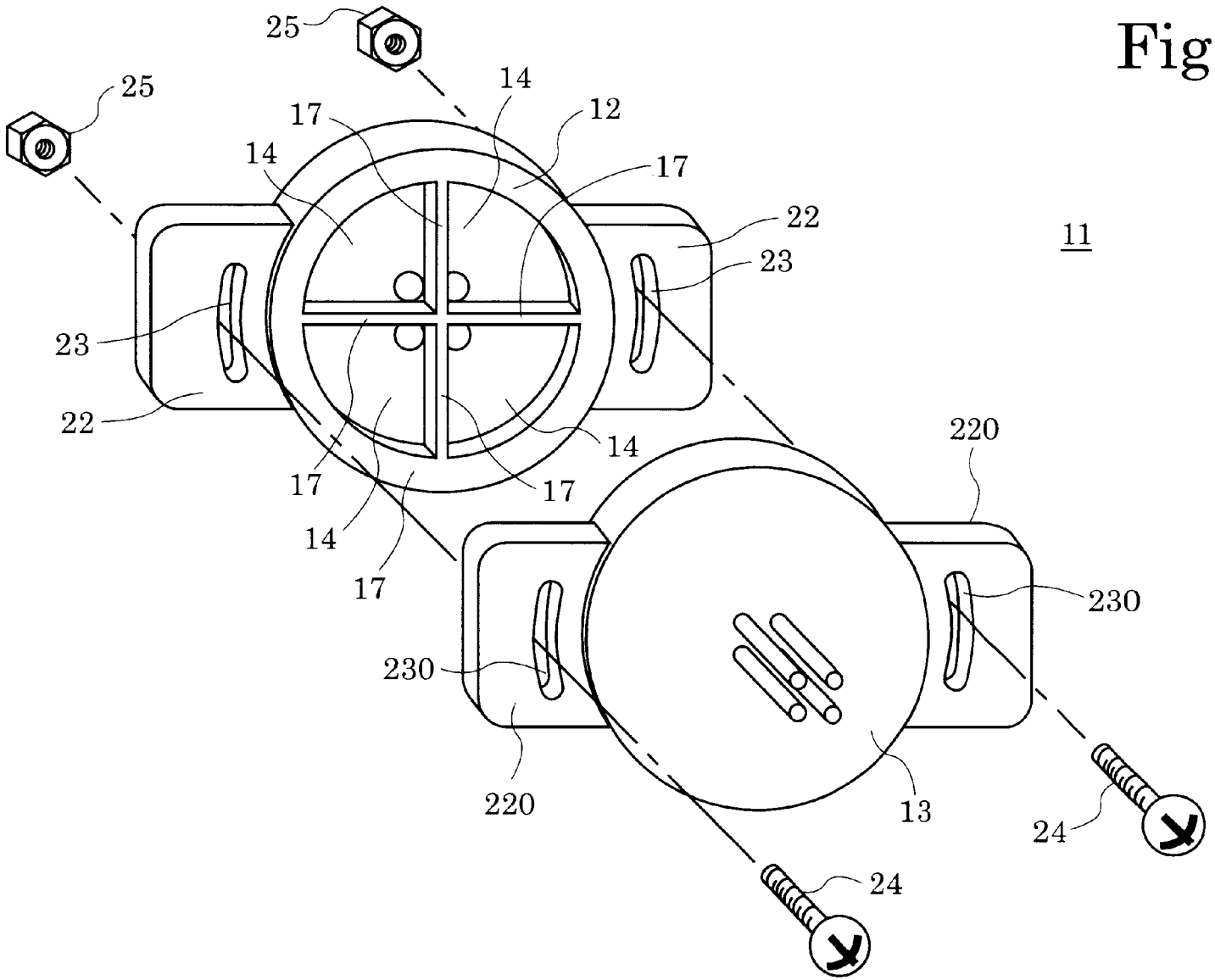
FIG. 7 is an exploded perspective view of an adjustable conductive support, which is composed of the movable member shown in FIG. 3 and the fixed member shown in FIG. 5, of the multiple-beam laser diode adjusting device shown in FIG. 1.
Figure 8:
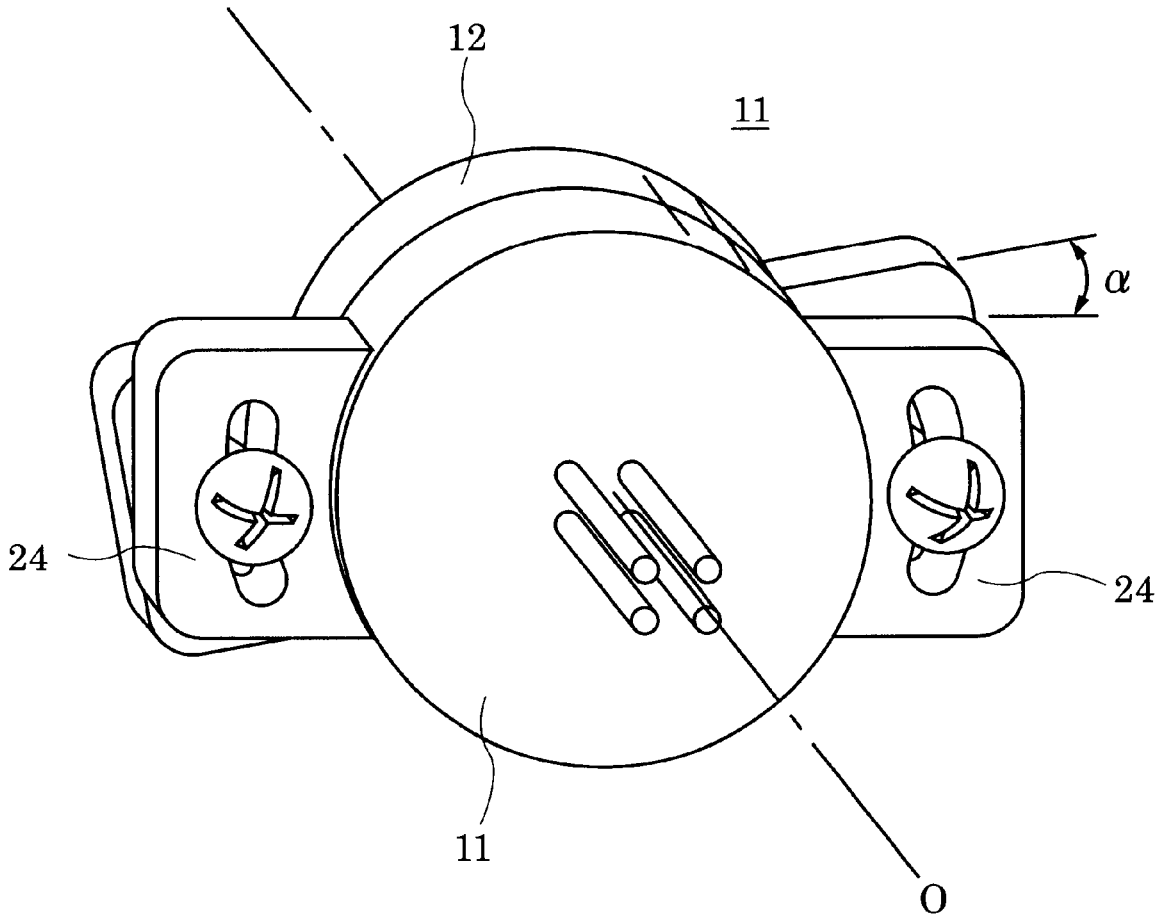
FIG. 8 is a perspective view of the adjustable conductive support shown in FIG. 7.

FIG. 1 shows an embodiment of a multiple-beam laser diode adjusting device 10 according to the present invention, while FIGS. 7 and 8 show an adjustable conductive support 11, which is provided as an element of the multiple-beam laser diode adjusting device shown in FIG. 1. Note that elements of the multiple-beam laser diode adjusting device 10 which are substantially the same as those shown in FIGS. 10 through 13 are designated by the same reference numerals.

As shown in FIG. 1, the multiple-beam laser diode adjusting device 10 is composed of a multiple-beam laser diode 1, a laser-diode-driver circuit board 2 and an adjustable conductive support 11 positioned between the multiple-beam laser diode 1 and the laser-diode-driver circuit board 2. The laser-diode-driver circuit board 2 is provided thereon with a circuit (not shown) for controlling the laser-emission of the multiple-beam laser diode 1.

Figure 2:
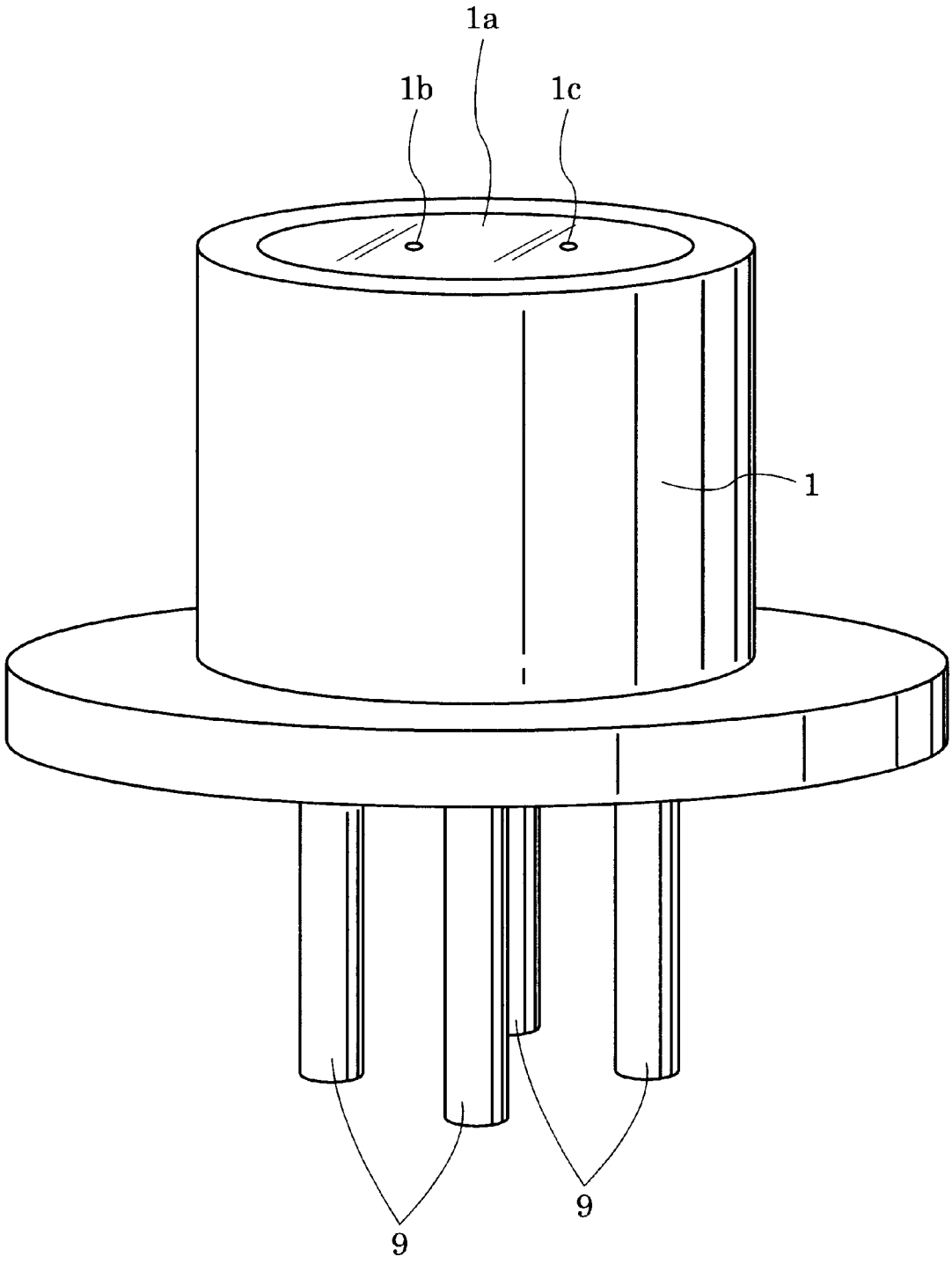
FIG. 2 is a perspective view of the multiple-beam laser diode shown in FIG. 1.

As shown in FIG. 2, the multiple-beam laser diode 1 is provided with a plurality of laser-beam emitting points, specifically, two laser-beam emitting points 1*b* and 1*c* in this particular embodiment. An upper part of the multiple-beam laser diode 1 from, which the laser beams emit, is covered by a glass cover 1*a*. The multiple-beam laser diode 1 is provided with four leads (terminal leads) 9 which come directly out of the bottom of the laser diode 1.

The adjustable conductive support 11 includes a movable member 12 and a fixed member 13. The movable member 12 is fixed to the fixed member 13, while the fixed member 13 is fixed to the laser-diode-driver circuit board 2. The multiple-beam laser diode 1 is fixed to the movable member 12.

Figure 4:
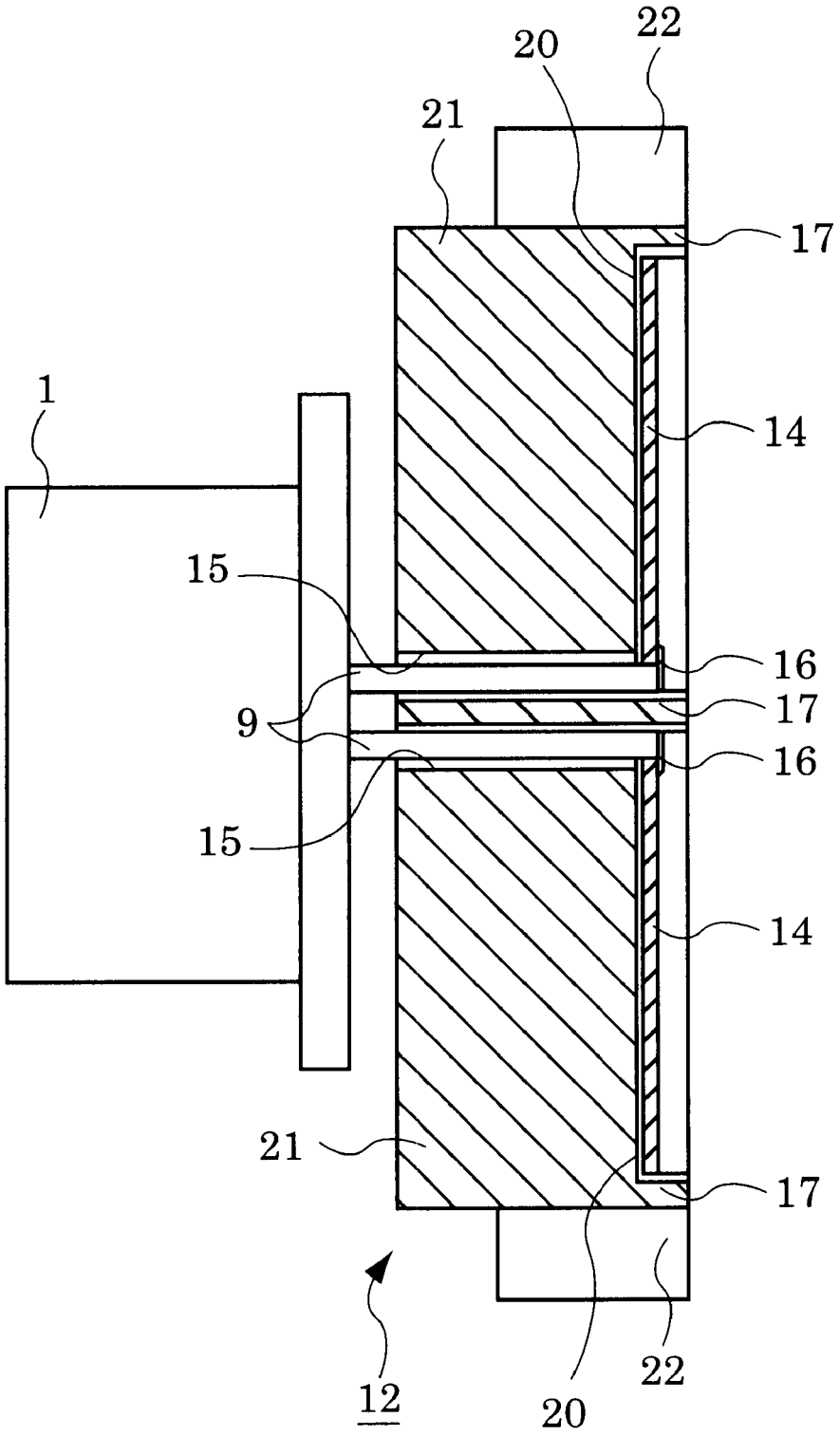
FIG. 4 is a transverse cross-sectional view of the movable member shown in FIG. 3.

The movable member 12 is provided, on a surface (i.e., a bottom surface) thereof which contacts the fixed member 13, with four conductive plates (first conductive plates) 14 (see FIG. 7), the number thereof corresponding to the number of the leads 9 of the multiple-beam laser diode 1. The movable member 12 is provided with four straight holes 15 (see FIG. 4) each having the top and bottom openings at the opposite ends thereof (the left and right openings as viewed in FIG. 4). The four leads 9 of the multiple-beam laser diode 1 are inserted into the four straight holes 15 from the top openings thereof, respectively. Only two of the four holes 15 are shown in FIG. 4. Each of the four conductive plates 14 is provided with a hole which is aligned with the bottom opening (the right opening as shown in FIG. 4) of the corresponding straight hole 15. The tip of each lead 9, which projects from the corresponding conductive plate 14 at the corresponding hole thereof, is soldered to the corresponding conductive plate 14 with solder 16. Accordingly, the four leads 9 of the multiple-beam laser diode 1 are electrically connected to the four conductive plates 14, respectively, and at the same time the multiple-beam laser diode 1 is fixed to the movable member 12.

Figure 3:
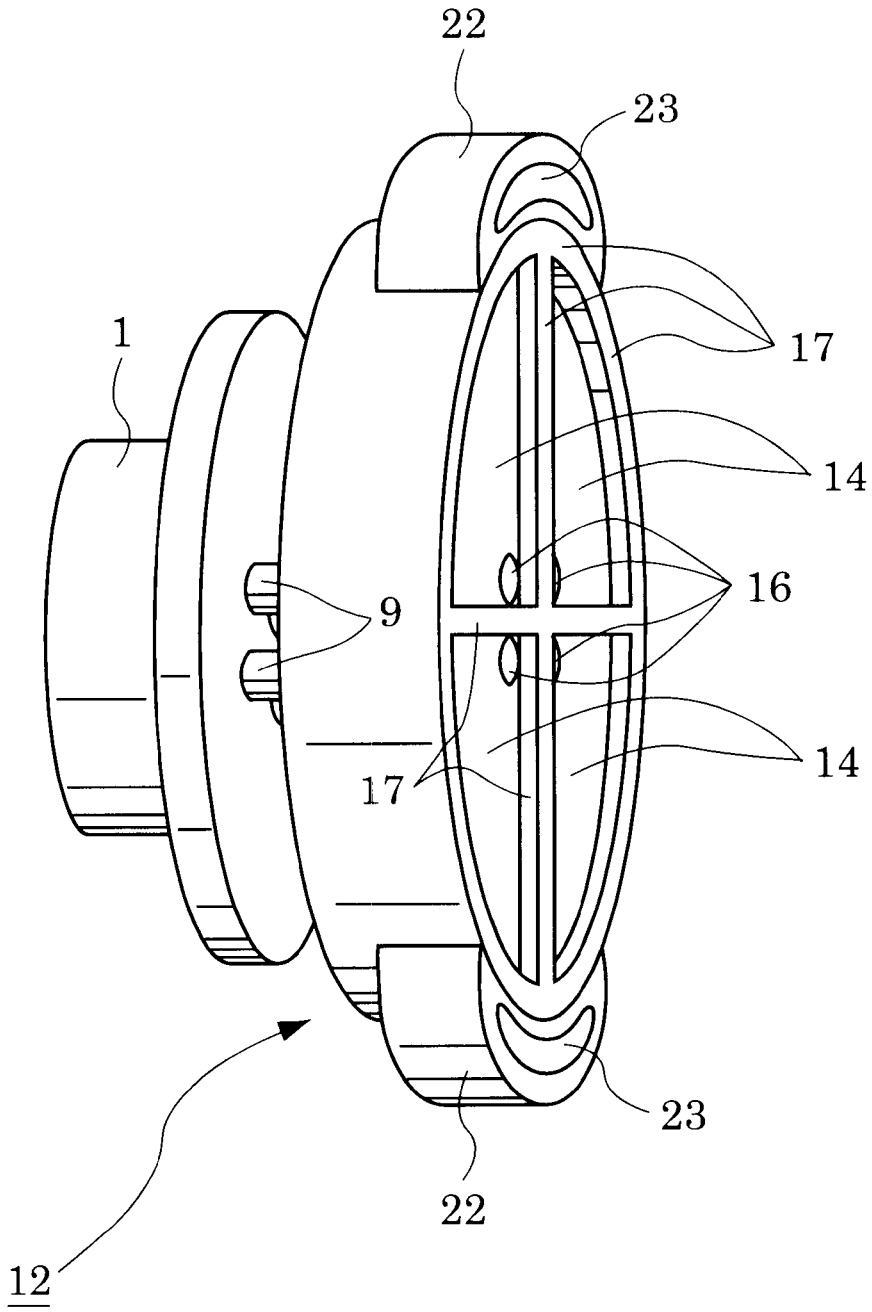
FIG. 3 is a perspective view of a movable member, to which the multiple-beam laser diode shown in FIG. 2 is fixed, of the multiple-beam laser diode adjusting device shown in FIG. 1.

As can be clearly seen in FIGS. 3 and 7, the movable member 12 is provided at the bottom thereof with insulator walls 17 which form four quarter-segment compartments in which the four conductive plates (first conductive plates) 14 are fitted.

Figure 5:
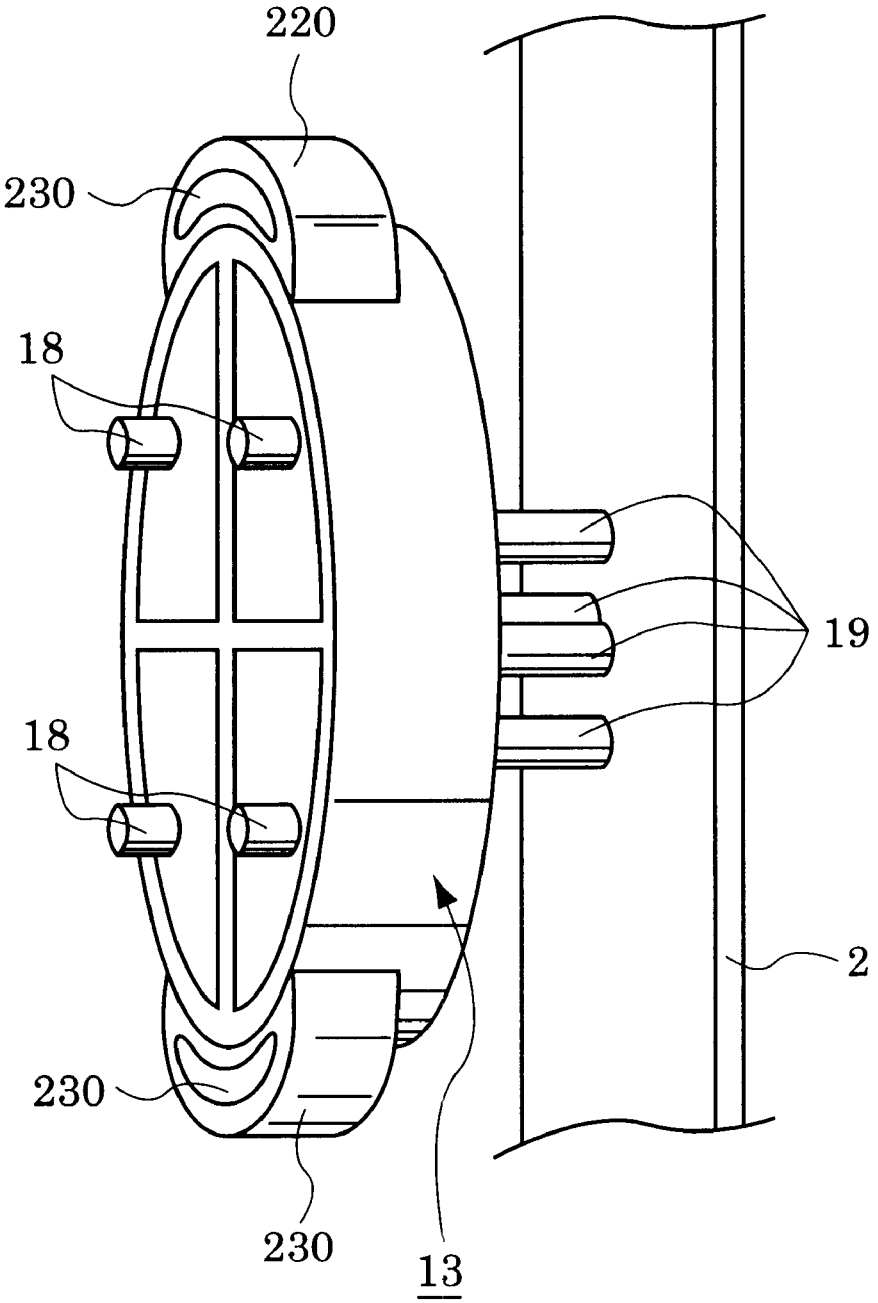
FIG. 5 is a perspective view of a fixed member of the multiple-beam laser diode adjusting device shown in FIG. 1.
Figure 6:
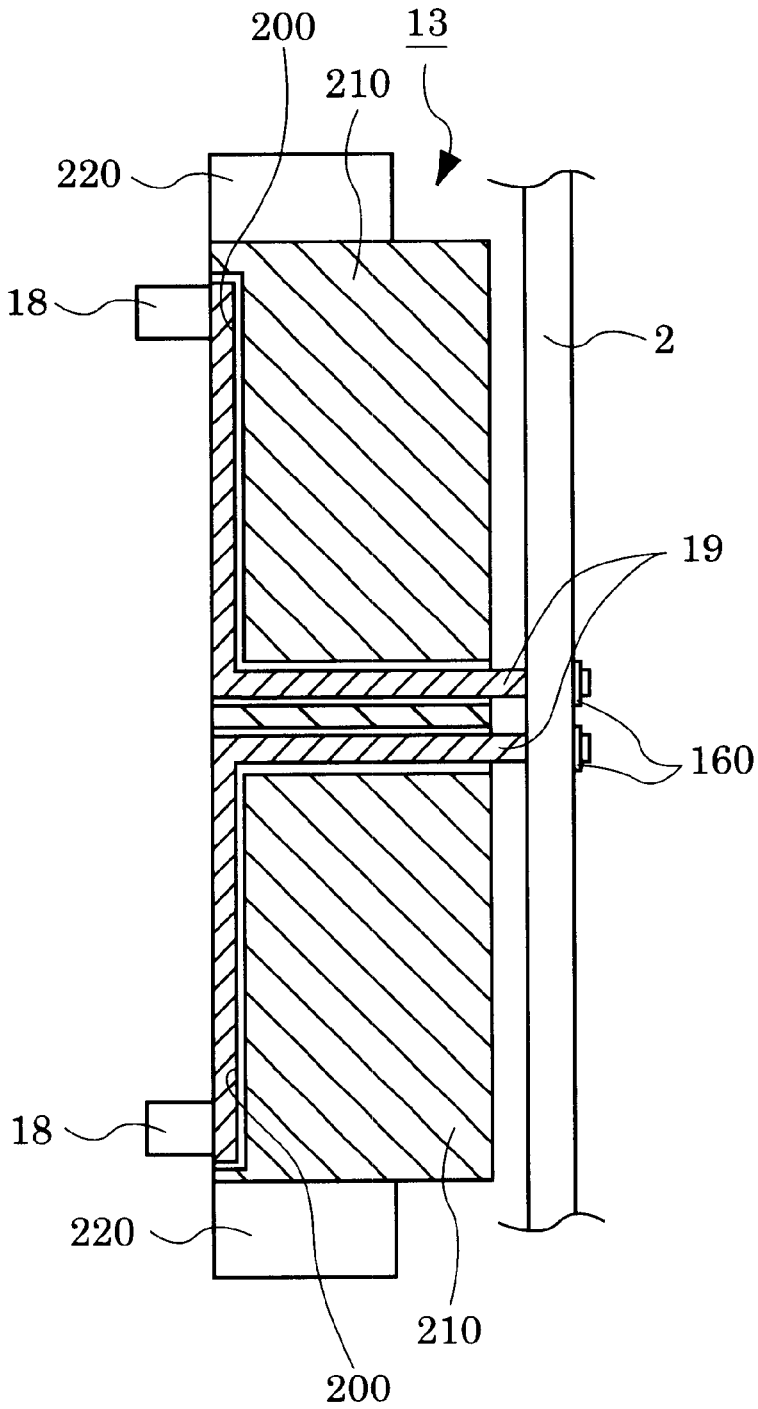
FIG. 6 is a transverse cross-sectional view of the fixed member shown in FIG. 5.

On the other hand, the fixed member 13 is provided, on a surface (i.e., an upper surface) thereof which contacts the movable member 12, with four cylindrical contacts (second conductive portions) 18 corresponding to the number of conductive plates 14 (see FIG. 5). As shown in FIG. 6, each cylindrical contact 18 is fixed to a corresponding conductive member having a lead 19. Only two of the four conductive members each having the lead 19 are shown in FIG. 6. Each lead 19 is inserted into a corresponding straight hole formed in the fixed member 13 so that the tip of each lead 19 comes out of the bottom of the fixed member 13 to be soldered to a corresponding land formed on the laser-diode-driver circuit board 2 with solder 160. Hence, the fixed member 13 is fixed to the laser-diode-driver circuit board 2.

As can be clearly seen in FIG. 5, the four cylindrical contacts 18 are arranged on the fixed member 13 at regular intervals on a circle having a center thereof coincident with the center of the circular upper surface of the fixed member 13, so as to be isolated from one another. The tip of each cylindrical contact 18 comes into contact with the corresponding conductive plate 14 to be electrically connected thereto. It is preferable that either one or both of each cylindrical contact 18 and each corresponding conductive plate 14 be made of a resilient conductive material, so that the four cylindrical contacts 18 come into pressing contact with the four conductive plates 14, respectively. Each cylindrical contact 18 can be replaced by an electrical brush which comes into pressing contact with the respective conductive plate 14 corresponding thereto.

The movable member 12 is constructed so that at least the inner peripheral surface of each straight hole 15 and the inner surfaces of the four quarter-segment compartments, in which the four conductive plates (first conductive plates) 14 are fitted, are entirely covered by a thin insulation layer 20 so that the leads 9 of the multiple-beam laser diode 1 are isolated from each other, in order to ensure a reliable electrical connection between the multiple-beam laser diode 1 and the laser-diode-driver circuit board 2. Likewise, the fixed member 13 is constructed so that at least the inner peripheral surface of each straight hole formed in the fixed member 13 and the surfaces thereof, with which each conductive member having the lead 19 is in contact, are entirely covered by a thin insulation layer 200 so that the leads 19 are isolated from each other, in order to ensure the electrical connection between the multiple-beam laser diode 1 and the laser-diode-driver circuit board 2. Except for the insulation layer 20, the movable member 12 is made of metal 21 to enhance the heat-radiation effect thereof. Similarly, except for the insulation layer 200, the fixed member 13 is made of metal 210 to enhance the heat-radiation effect thereof.

As can be clearly seen in FIG. 7, the movable member 12 has a substantially cylindrical body and is provided with a pair of protrusions 22 which extend radially from the cylindrical body in opposite directions. Likewise, the fixed member 13 has a substantially cylindrical body and is provided with a corresponding pair of protrusions 220 which extend radially from the cylindrical body in opposite directions. The pair of protrusions 22 are respectively provided with a pair of arced slots 23 which are formed along a circle having a center which is coincident with the center of the cylindrical body of the movable member 12. Likewise, the pair of protrusions 220 are respectively provided with a corresponding pair of arced slots 230 which are formed along a circle having a center which is coincident with the center of the cylindrical body of the fixed member 13, so that the pair of arced slots 230 are aligned with the pair of arced slots 23 in the direction of emission of laser beams (i.e., in the right/left direction as viewed in FIG. 1). The movable member 12 is fixed to the fixed member 13 by two screw bolts 24 each inserted into a corresponding pair of protrusions 23 and 230, and two screw nuts 25 are each engaged with each respective corresponding screw bolt 24. The screw bolts 24 and the screw nuts 25 constitute a fixing device.

As shown in FIG. 8, the fixing angle $\alpha$ of the movable member 12 relative to the fixed member 13, about a common axis O of the movable member 12 and the fixed member 13; can be manually adjusted by rotating the movable member 12 relative to the fixed member 13 about the common axis O with the two screw bolts 24 being loosened relative to the screw nuts 25. The common axis O extends parallel to each laser beam emitted from the multiple-beam laser diode 1.

The movable member 12 cannot be rotated beyond a predetermined angle of rotation because each of the cylindrical contacts 18 of the fixed member 13 bumps against either of the two corresponding insulator walls 17 of the movable member 12 at opposite terminals of the rotatable range of the movable member 12 relative to the fixed member 13. Therefore, the fixing angle $\alpha$ of the movable member 12 is determined within a predetermined range which corresponds to the rotatable range of the movable member 12 relative to the fixed member 13. This structure prevents each of the cylindrical contacts 18 of the fixed member 13 from contacting a conductive plate 14 other than the conductive plate 14 corresponding thereto.

The operation of the multiple-beam laser diode adjusting device 10, which connects the multiple-beam laser diode 1 with the laser-diode-driver circuit board 2, will be hereinafter discussed.

Figure 9:
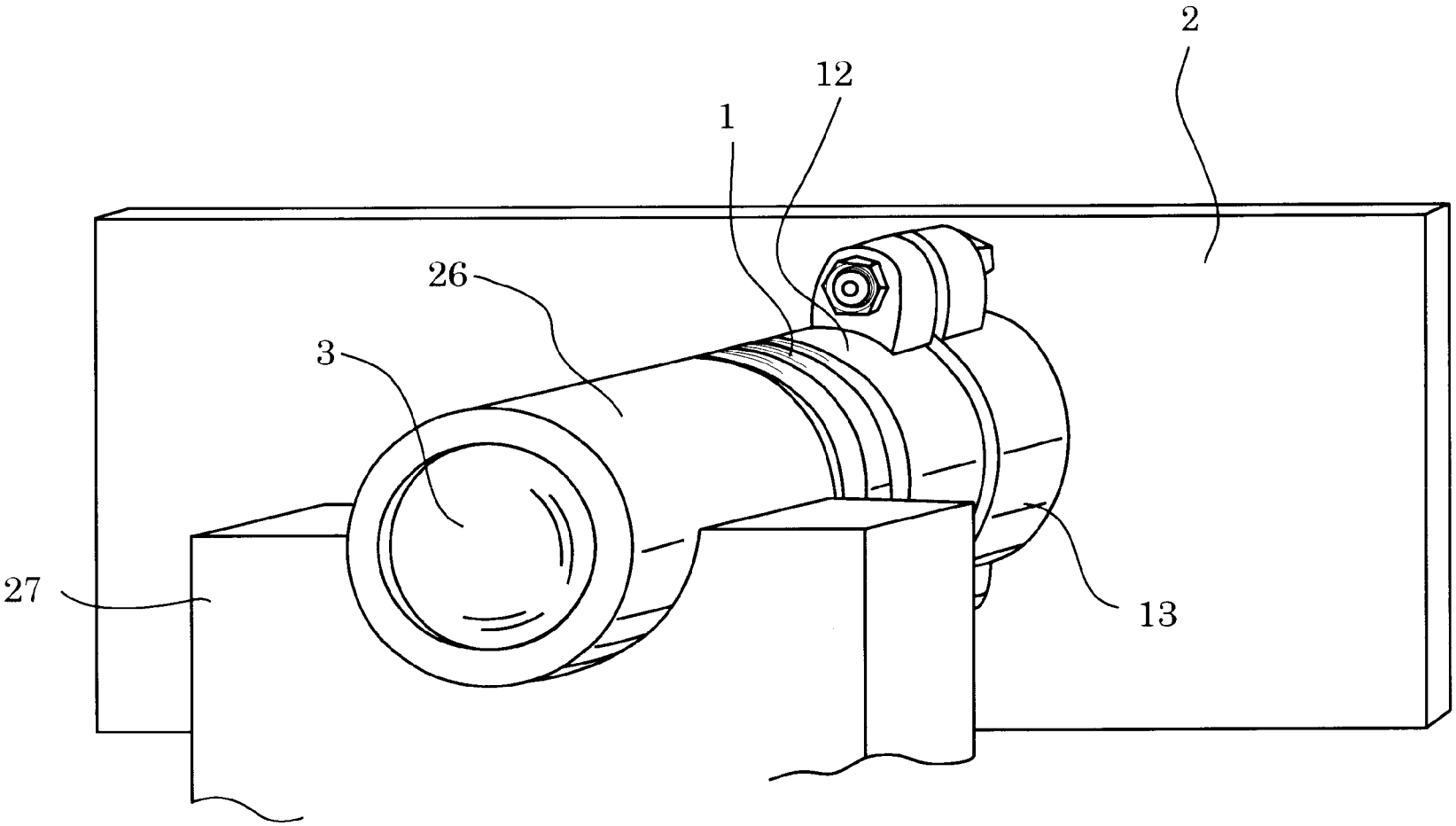
FIG. 9 is a perspective view of a fundamental portion of a laser-beam scanning system to which the multiple-beam laser diode adjusting device is fixed, according to the present invention shown in FIG. 1.
Figure 10:
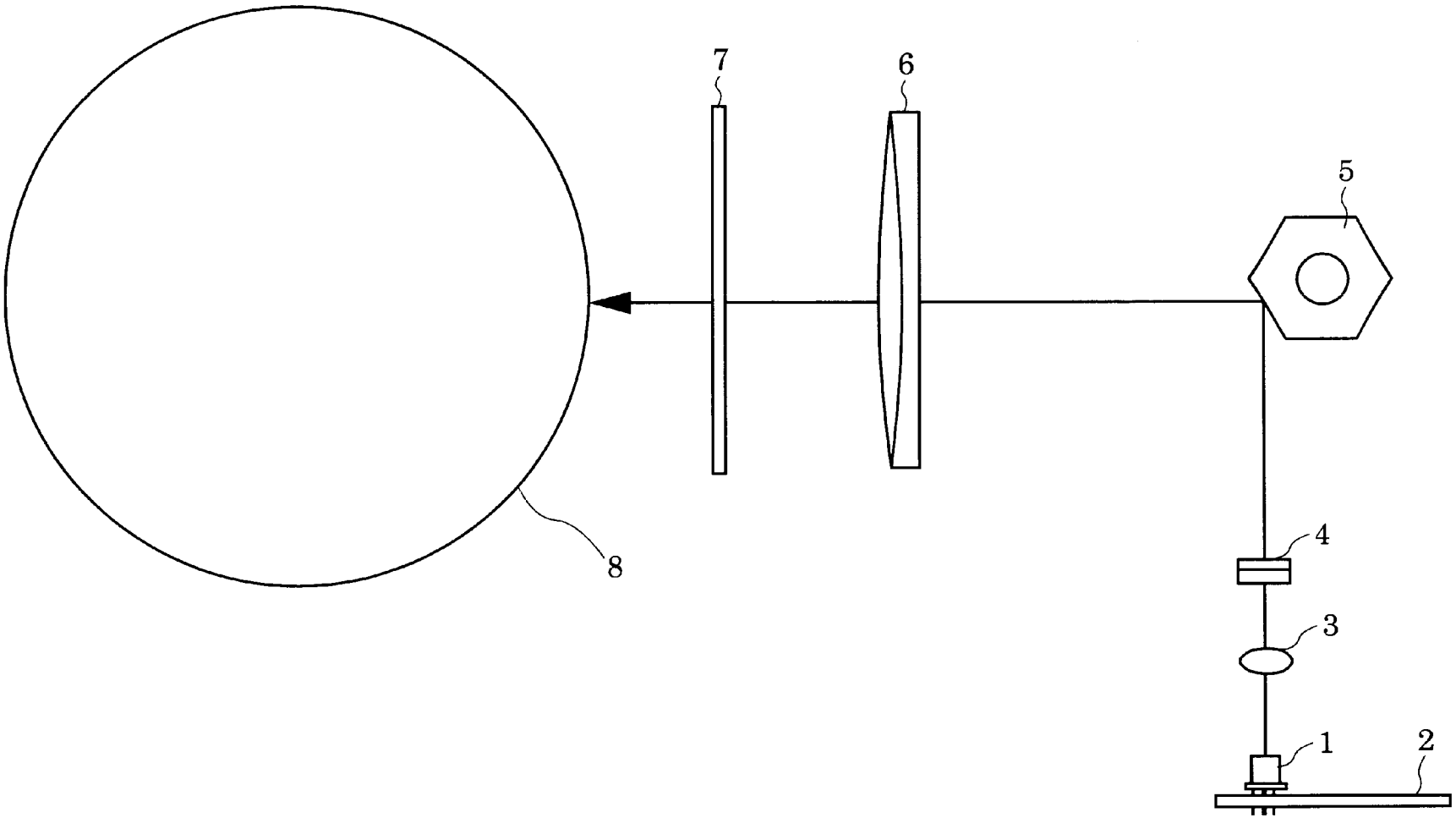
FIG. 10 is a schematic plan view of a multi-beam laser scanning system, showing fundamental elements thereof.
Figure 11A:
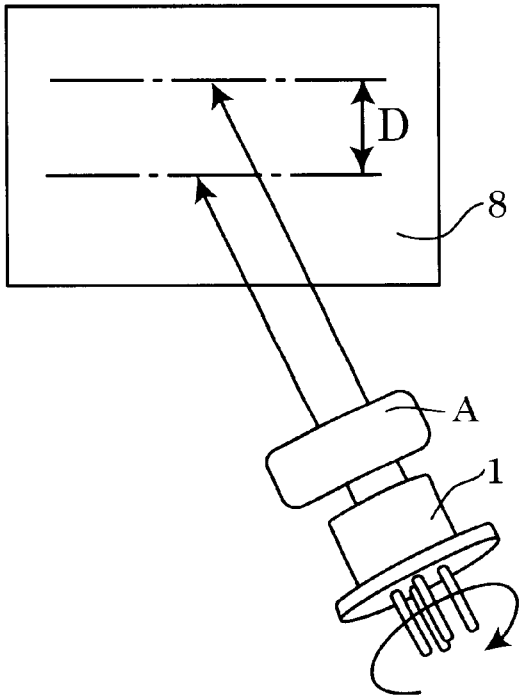
FIG. 11A is an explanatory view showing a method of adjusting the interval of laser beams emitted from a multiple-beam laser diode by rotating the same, wherein an interval "D" between two laser beams exits before adjustment.
Figure 11B:
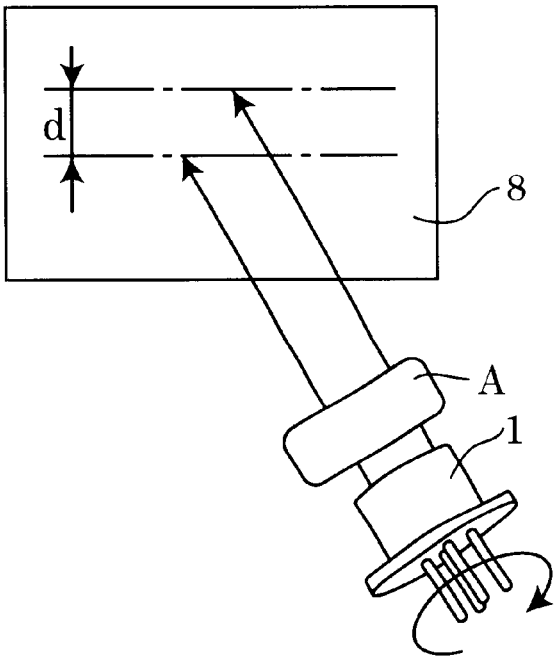
FIG. 11B is an explanatory view showing a method of adjusting the interval of laser beams emitted from a multiple-beam laser diode by rotating the same, wherein the interval between the two laser beams is adjusted to a proper interval "d"
Figure 11C:
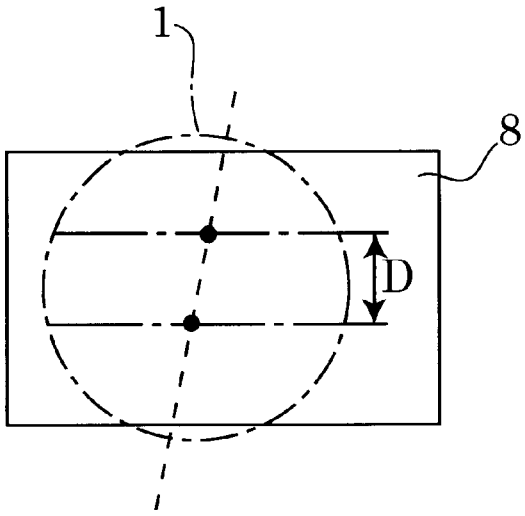
FIG. 11C is a plan view of part of the photoconductive surface of a photoconductive drum to which the laser beams emitted from the multiple-beam laser diode are incident, showing the respective incident positions of the laser beams and the interval thereof on the photoconductive drum in the case shown in FIG. 11A.
Figure 11D:
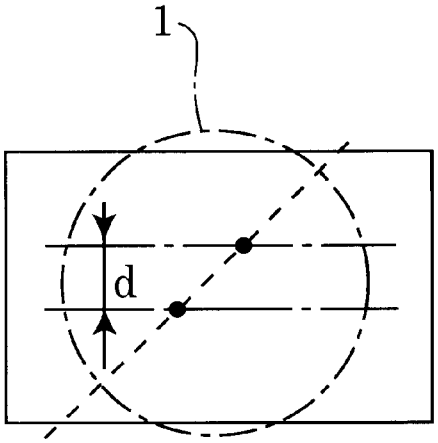
FIG. 11D is a plan view of part of the photoconductive surface of a photoconductive drum to which the laser beams emitted from the multiple-beam laser diode are incident, showing the respective incident positions of the laser beams and the interval thereof on the photoconductive drum in the case shown in FIG. 11B.
Figure 12:
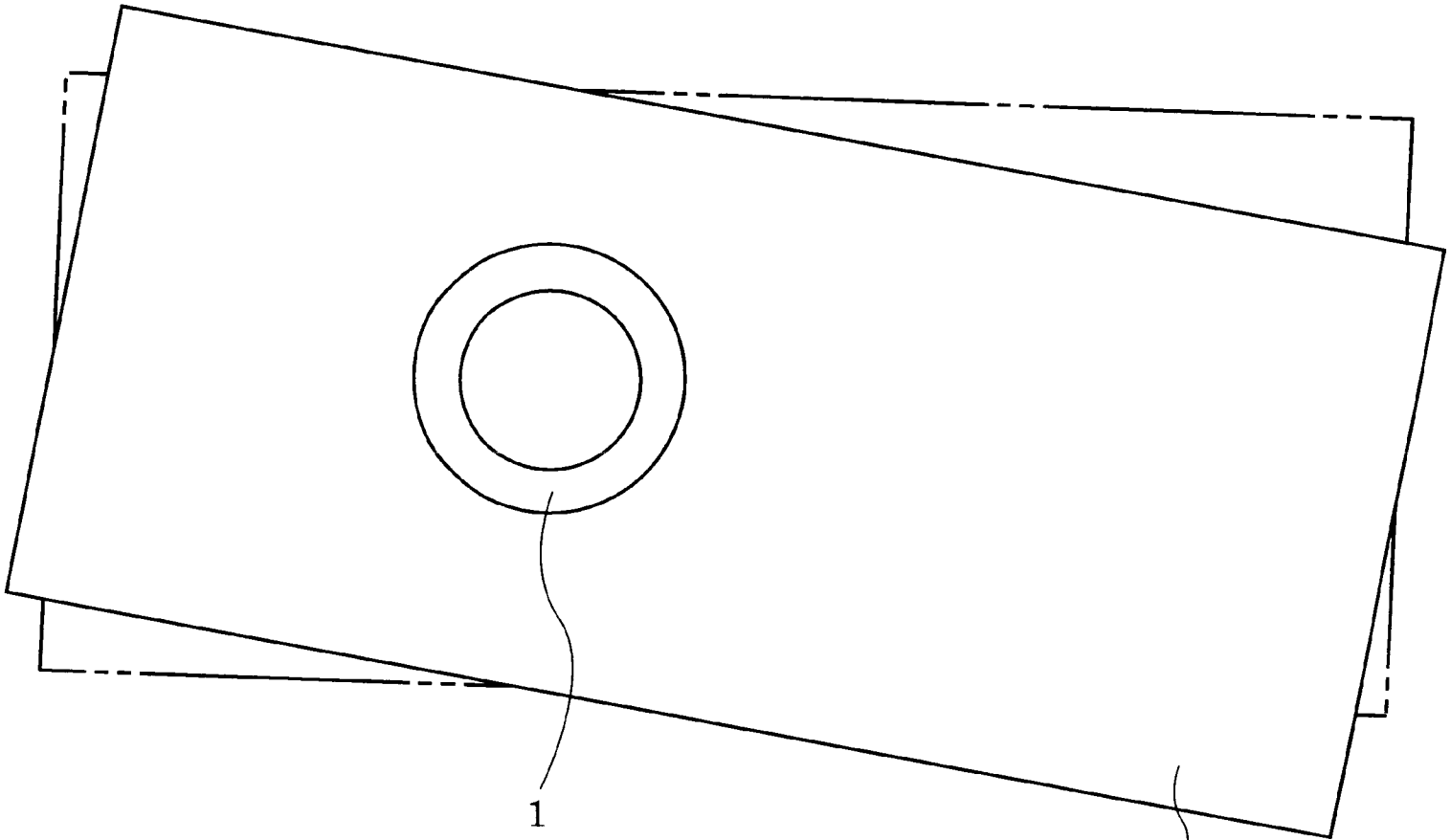
Fig.12 Prior Art
FIG. 12 is a plan view of a laser-diode-driver circuit board to which a multiple-beam laser diode is fixed, showing a state where the circuit board is shifted from a position shown by a one-dot chain line to a position shown by a solid line.
Figure 13:
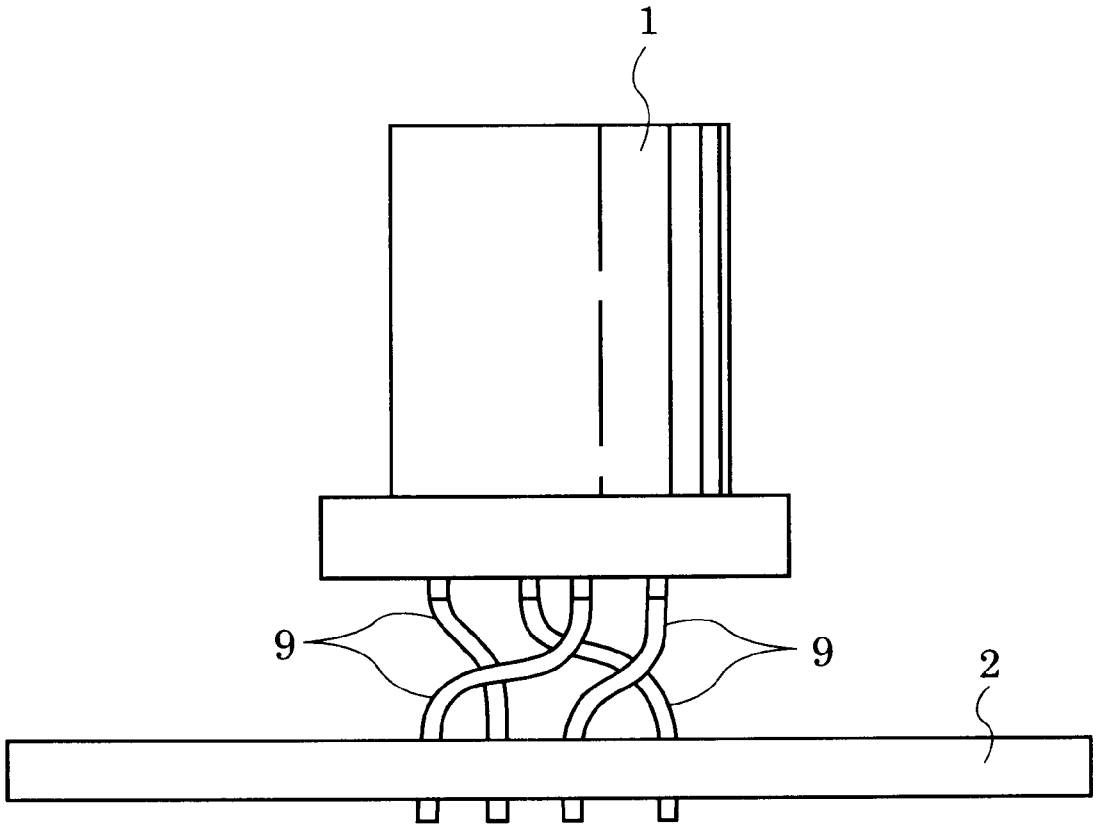
FIG. 13 is a side elevational view of a laser-diode-driver circuit board to which a multiple-beam laser diode is fixed, showing a state where the multiple-beam laser diode is fixed to the circuit board with the leads of the multiple-beam laser diode being twisted.

As shown in FIG. 9, a cylindrical member 26 which supports the collimating lens 3 at the tip thereof is connected with the multiple-beam laser diode 1, which is fixed to a multi-beam laser scanning system. The cylindrical member 26 is firmly supported by a U-shaped fixed supporting frame 27, so that the laser beams are emitted by the multiple-beam laser diode 1 in a predetermined direction.

In order to adjust the intervals of the laser beams emitted from the multiple-beam laser diode 1 in the sub-scanning direction, firstly the multiple-beam laser diode 1 is driven to emit laser beams so that the laser beams are incident on the photoconductive surface of the drum 8. Secondly the interval of the two adjacent spots of the laser beams incident on the photoconductive surface of the drum 8 are measured. Thirdly the two screw nuts 25 are loosened; and fourthly the movable member 12 is rotated relative to the fixed member 13 by an angle of rotation necessary for adjustment in accordance with the measured interval. Lastly, the two screw bolts 24 are tightened relative to the two screw nuts 25, respectively, while maintaining the adjusted fixing angle $\alpha$ of the movable member 12. The four cylindrical contacts 18 remain in slidable contact with the four conductive plates 14, respectively, while the movable member 12 is rotated relative to the fixed member 13 with the two screw bolts 24 being loosened relative to the corresponding screw nut 25.

As can be understood from the above description, since the adjustable conductive support 11, which includes the movable member 12 and the fixed member 13, is positioned between the multiple-beam laser diode 1 and the laser-diode-driver circuit board 2, the multiple-beam laser diode 1 can be easily rotated relative to the laser-diode-driver circuit board 2. Accordingly, the laser-diode-driver circuit board 2 does not need to be shifted from the initial position thereof, or the leads 9 of the multiple-beam laser diode 1 do not need to be twisted in order to rotate the multiple-beam laser diode 1 relative to the laser-diode-driver circuit board 2.

Since the multiple-beam laser diode 1 can be easily rotated relative to the laser-diode-driver circuit board 2 via the adjustable conductive support 11, the intervals of the laser beams in the sub-scanning direction can be quickly easily adjusted compared to the prior art.

Since the multiple-beam laser diode 1 can be easily rotated relative to the laser-diode-driver circuit board 2 via the adjustable conductive support 11, the restriction on the arrangement of the laser-diode-driver circuit board 2 is reduced, and the degree of freedom in the arrangement of the laser-diode-driver circuit board 2 is increased.

According to the present embodiment of the multiple-beam laser diode adjusting device 10, since the adjustable conductive support 11 is made of metal, the adjustable conductive support 11 also functions as a radiator for the multiple-beam laser diode 1, so that the heat-radiation effect of the laser-diode-driver circuit board 2 is improved.

Since the multiple-beam laser diode 1 is not like a conventional laser diode, which is soldered directly to the laser-diode-driver circuit board 2, but is soldered to the movable member 12 which can be detached from the fixed member 13, the multiple-beam laser diode 1 can be easily detached from the laser-diode-driver circuit board 2 by simply removing the two screw bolts 24. Accordingly, the multiple-beam laser diode 1 can be easily replaced by a new one.

Obvious changes may be made in the specific embodiment of the present invention described herein, such modifications being within the spirit and scope of the invention claimed. It is indicated that all matter contained herein is illustrative and does not limit the scope of the present invention.

What is claimed is:

1. A multiple-beam laser diode adjusting device comprising:

a multiple-beam laser diode which emits a plurality of laser beams;

a circuit board on which a circuit for controlling a laser-emission of said multiple-beam laser diode is mounted; and an adjustable conductive support, positioned between said multiple-beam laser diode and said circuit board, which allows said multiple-beam laser diode to be rotated relative to said circuit board while ensuring an electrical connection between said multiple-beam laser diode and said circuit board;

wherein said adjustable conductive support comprises:

a fixed member which is fixed to said circuit board; and a movable member to which said multiple-beam laser diode is fixed; and wherein said movable member is mounted on said fixed member to be rotatable together with said multiple-beam laser diode relative to said fixed member while ensuring said electrical connection between said multiple-beam laser diode and said circuit board.

2. The multiple-beam laser diode adjusting device according to claim 1, wherein:

said multiple-beam laser diode comprises a plurality of terminal leads;

said movable member comprising a corresponding plurality of first conductive portions which are electrically connected with said plurality of terminal leads;

fixed member comprising a corresponding plurality of second conductive portions which contact said plurality of first conductive portions, respectively, to ensure said electrical connection between said multiple-beam laser diode and said circuit board; and said adjustable conductive support comprising a device which restricts rotation of said movable member within a predetermined rotational angle, wherein each of said plurality of first conductive portions is electrically connected with only a corresponding one of said plurality of second conductive portions and disconnected from any other of said plurality of second conductive portions.

3. The multiple-beam laser diode adjusting device according to claim 2, wherein each of said plurality of first conductive portions remains in slidable contact with a corresponding one of said plurality of second conductive portions.

4. The multiple-beam laser diode adjusting device according to claim 1, wherein said movable member comprises a first cylindrical body and two first protrusions which extend radially from said first cylindrical body in opposite directions;

said fixed member comprising a second cylindrical body and two second protrusions which extend radially from said second cylindrical body in opposite directions; and said adjustable conductive support comprising a fixing device for fixing said two first protrusions to said two second protrusions, respectively, said fixing device comprising at least one pair of screw bolts and at least one pair of corresponding screw nuts.

5. An adjustable conductive support comprising:

a movable member to which a multiple-beam laser diode is fixed; and a fixed member which is fixed to a circuit board on which a circuit for controlling a laser-emission of said multiple-beam laser diode is mounted;

wherein said movable member is mounted on said fixed member to be rotatable together with said multiple-beam laser diode relative to said fixed member while ensuring said electrical connection between said multiple-beam laser diode and said circuit board.

6. The adjustable conductive support according to claim 5, wherein said multiple-beam laser diode comprises a plurality of terminal leads;

said movable member comprising a corresponding plurality of first conductive portions which are electrically connected with said plurality of terminal leads;

said fixed member comprising a corresponding plurality of second conductive portions which contact said plurality of first conductive portions, respectively, to ensure said electrical connection between said multiple-beam laser diode and said circuit board; and said adjustable conductive support comprising a device which restricts rotation of said movable member within a predetermined rotational angle relative to said fixed member, wherein each of said plurality of first conductive portions is electrically connected with only a corresponding one of said plurality of second conductive portions and disconnected from any other of said plurality of second conductive portions.

7. The adjustable conductive support according to claim 6, wherein each of said plurality of first conductive portions remains in slidable contact with a corresponding one of said plurality of second conductive portions.

8. The adjustable conductive support according to claim 5, wherein said movable member comprises a first cylindrical body and two first protrusions which extend radially from said first cylindrical body in opposite directions;

said fixed member comprising a second cylindrical body and two second protrusions which extend radially from said second cylindrical body in opposite directions; and said adjustable conductive support comprising a fixing device for fixing said two first protrusions to said two second protrusions, respectively, said fixing device comprising at least one pair of screw bolts and at least one pair of corresponding screw nuts.

* * * * *